US005936176A

United States Patent [19]

Lombardi

[11] Patent Number: 5,936,176

[45] Date of Patent: Aug. 10, 1999

[54] PERCUSSION INSTRUMENT ARM ADAPTER

[75] Inventor: Donald G. Lombardi, Thousand Oaks, Calif.

[73] Assignee: Drum Workshop, Inc., Oxnard, Calif.

[21] Appl. No.: 09/036,771

[22] Filed: Mar. 9, 1998

[51] Int. Cl.[6] ..... G10D 13/02

[52] U.S. Cl. ..... 84/421; 84/422.3; 248/291.1

[58] Field of Search ..... 84/421, 422.3; 248/291.1

[56] References Cited

U.S. PATENT DOCUMENTS 5,836,561 11/1998 Liao ..... 248/291.1

*Primary Examiner*—William M. Shoop, Jr.
*Assistant Examiner*—Shih-yung Hsieh
*Attorney, Agent, or Firm*—William W. Haefliger

[57] ABSTRACT

In a percussion instrument arm adapter, the combination comprising a longitudinally extending arm; a first clamp unit carried at one end of the arm, and a second clamp unit carried at the opposite end of the arm; at least one of the units having primary elements including a carrier, a primary clamping plate and a secondary clamping plate, a primary fastener interconnecting the carrier and primary clamping plate to laterally retain the primary clamping plate to the carrier, and allow adjustable rotation of the primary clamping plate relative to the carrier, and a secondary fastener adjustably interconnecting the secondary clamp plate and first clamping plate, the plates defining rod clamping surfaces; and whereby a rod may be carried by an adapter by reception and retention by and between the plates.

20 Claims, 6 Drawing Sheets

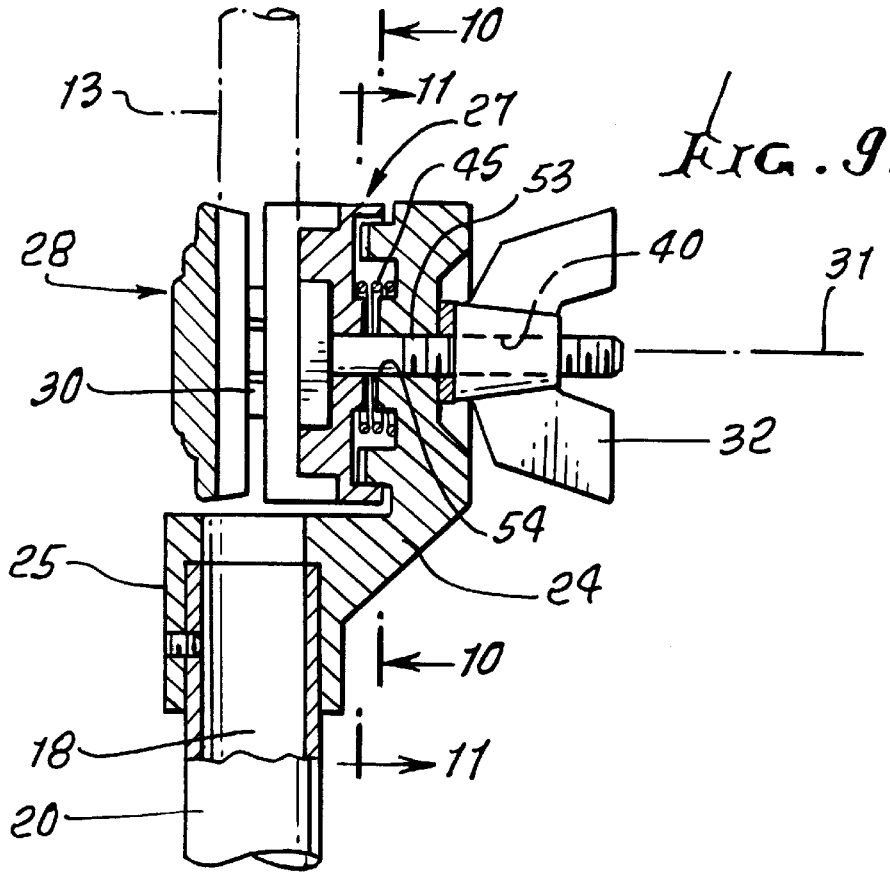
FIG. 9.
FIG. 10.
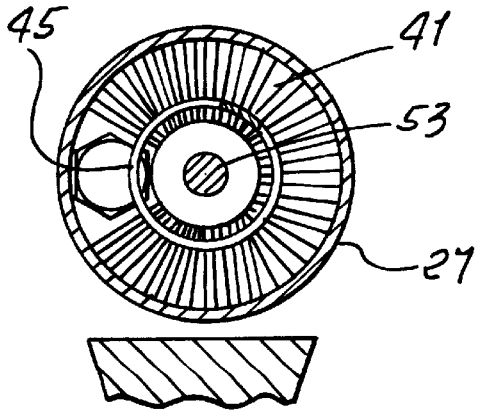
FIG. 11.
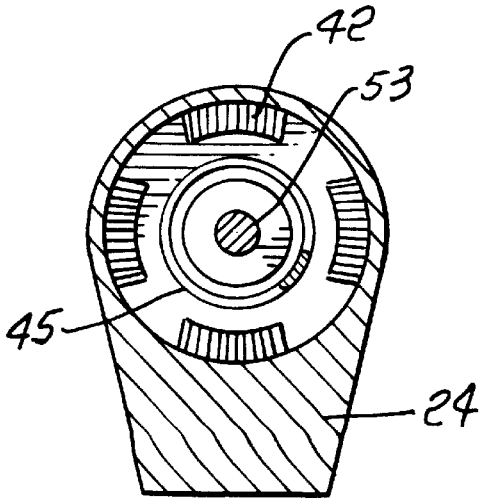

PERCUSSION INSTRUMENT ARM ADAPTER

BACKGROUND OF THE INVENTION

This invention relates generally to percussion instrument support mechanisms; and more particularly to an improved, readily and easily installable percussion instrument arm adapter. Percussion instruments such as cymbals and drums are frequently mounted on linkage mechanism in the form of arms that interconnect at multiple points. There is continual need for improved mechanisms which are readily and easily interconnectable by musicians, so as not to loosen or otherwise deteriorate in use, often times involving heavy and frequent impacting of the instruments. So far as I am aware, no prior arm adapter incorporates the unusually advantageous structure, functioning and highly advantageous results as are now incorporated in the herein described arm adapter.

SUMMARY OF THE INVENTION

It is a major object of the invention to provide an unusually effective improved percussion instrument arm adapter, having multiple advantages as will appear.

Basically the device comprises a) a longitudinally extending arm, b) a first clamp unit carried at one end of the arm, and a second clamp unit carried at the opposite end of the arm, c) at least one of the clamp units having primary elements including a carrier, a primary clamping plate and a secondary clamping plate, a primary fastener interconnecting the carrier and primary clamping plate to laterally retain the primary clamping plate to the carrier, and allow adjustable rotation of the primary clamping plate relative to the carrier, and a secondary fastener adjustably interconnecting the secondary clamp plate and first clamping plate, the plates defining rod clamping surfaces, d) whereby a rod may be carried by said adapter by reception and retention by and between said plates.

As will appear, means may be provided to relatively pivotally interconnect the clamping plates; a spring may be provided and located to urge the second plate to swing generally laterally, in a direction away from the first plate; and the fasteners including large wing nuts may be located laterally on opposite sides of the unit to enable assurance and ease of connection of the adapter to support and supporting rods, as will appear.

It is a further object of the invention to provide the plates and carrier to be generally cylindrical and define a laterally extending primary axis about which the two plates are swingable relative to the carrier, the second fastener wing nut defining a secondary axis offset from said primary axis.

Yet another object is to provide one unit carrier bore having rotary connection with said arm.

As will appear the other of the units has secondary elements corresponding to said primary elements.

A further object includes provision, in combination, of:

a) a longitudinally elongated arm, b) said arm having a support body at each end thereof, each support body having a carrier laterally offset form said longitudinal axis, c) and a clamping unit carried by each carrier to be adjustably rotatable above a lateral axis, d) each clamping unit having rod clamping elements adapted for adjustment to clamp to a rod.

As will appear, the rod clamping elements of each unit may typically include:

i) a primary clamping element carried by the carrier.

ii) a secondary clamping element movably carried by the primary clamping element and iii) a fastener operatively interconnecting those elements for relative movement to adjustably clamp a rod therebetween.

These and other objects and advantages of the invention, as well as the details of an illustrative embodiment, will be more fully understood from the following specification and drawings, in which:

DRAWING DESCRIPTION

FIG. 9 is a section taken on lines 9—9 of FIG. 6;

FIG. 10 is a section taken on lines 10—10 of FIG. 9;

FIG. 11 is a section taken on lines 11—11 of FIG. 9; and

DETAILED DESCRIPTION OF PREFERRED EMBODIMENT

Figure 1:
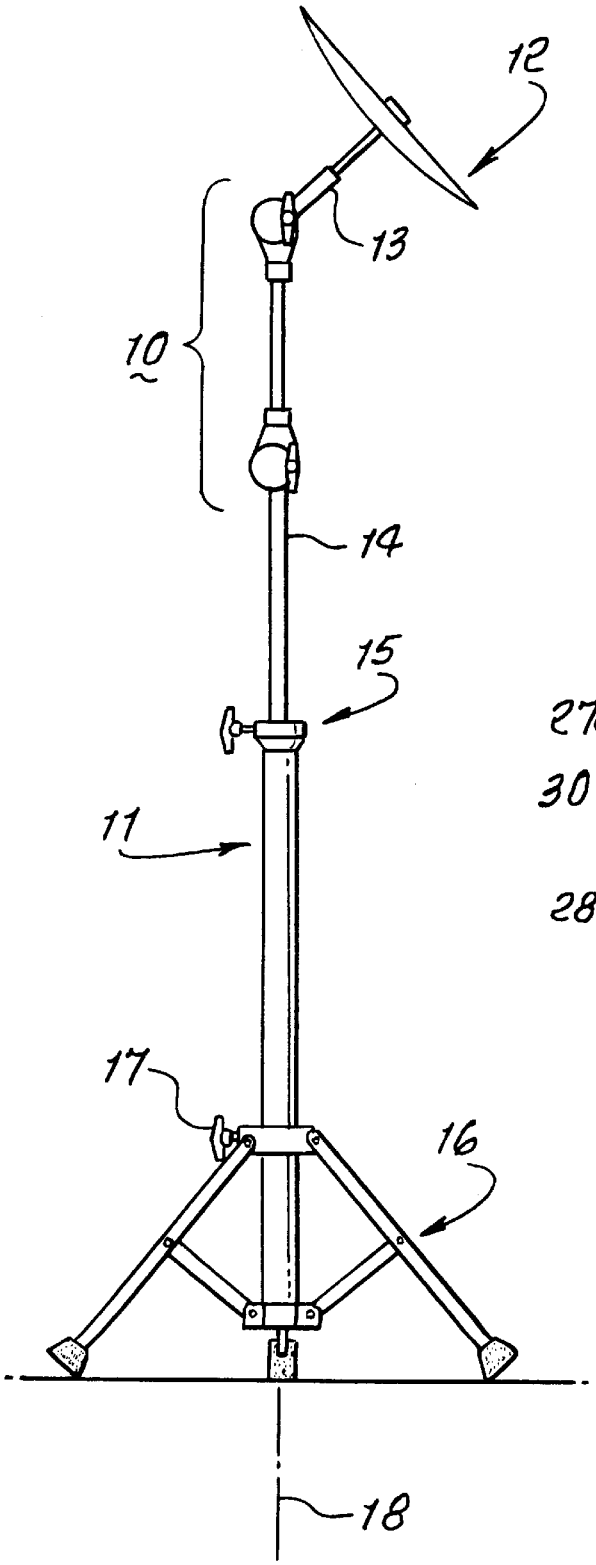
FIG. 1 is an elevation showing the arm adapter installed in a cymbal support apparatus.

In the drawings, a percussion instrument arm adapter is shown at 10. In FIG. 1, it is integrated into an upright stand 11 for a cymbal 12 carried by an upper rod 13. A lower rod 14 supports the adapter 10, and is carried by lengthwise vertically adjustable mechanism 15 supported by legs 16. Loosening of a set screw 17 allows leg collapse toward vertical axis 18.

Figure 2:
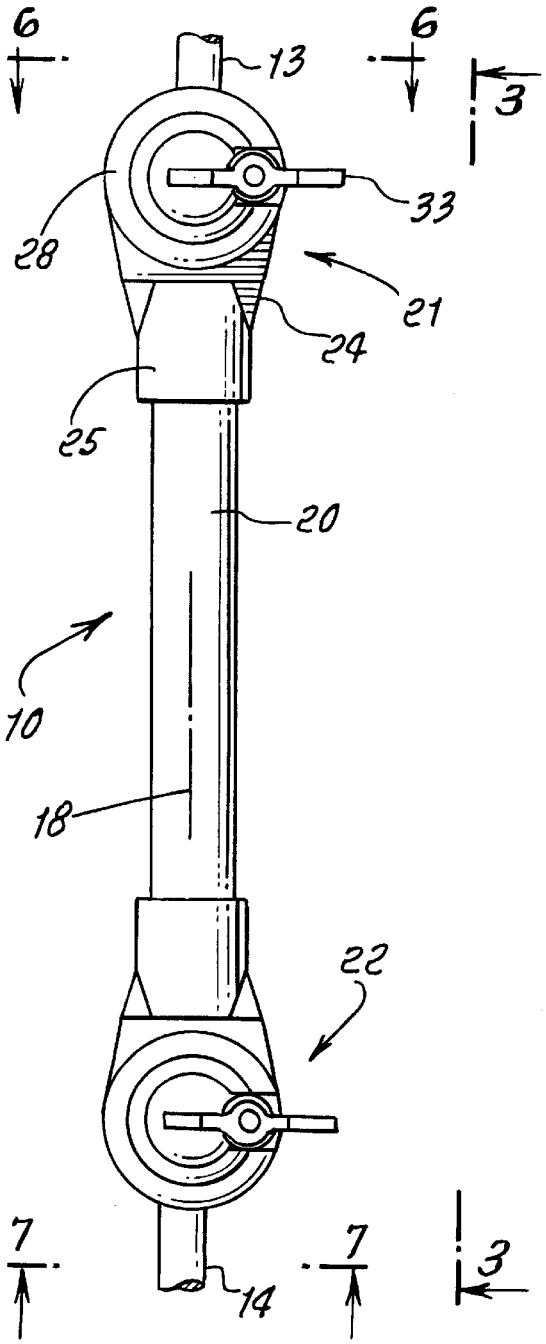
FIG. 2 is a front elevation of the arm adapter shown in an enlarged form.
Figure 3:
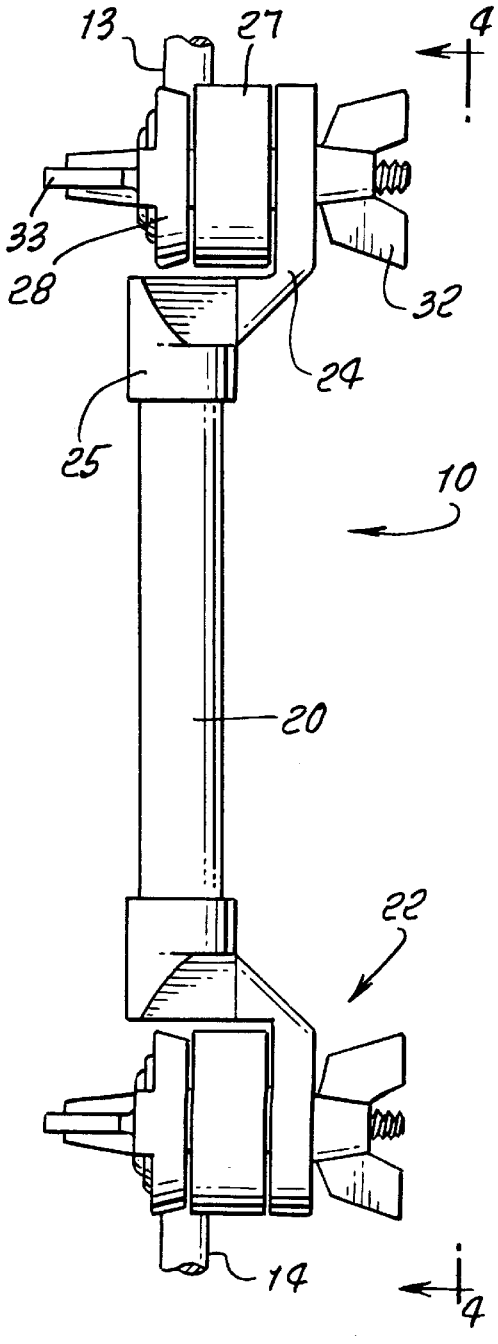
FIG. 3 is a side elevation taken on lines 3—3 of FIG. 2.
Figure 4:
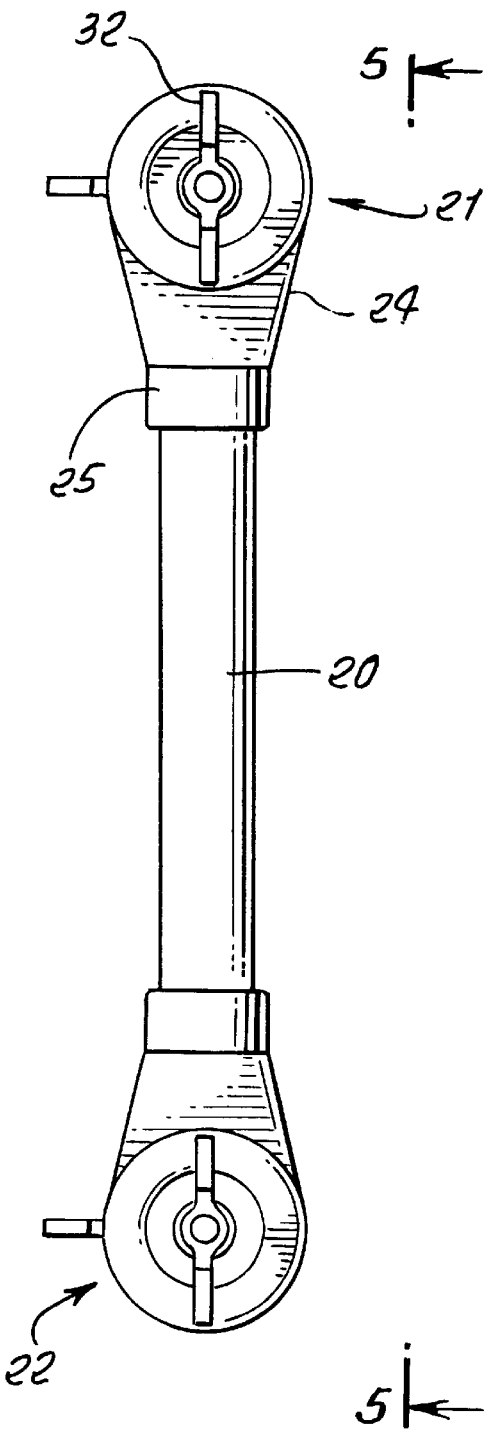
FIG. 4 is a rear elevation taken on lines 4—4 of FIG. 3.
Figure 5:
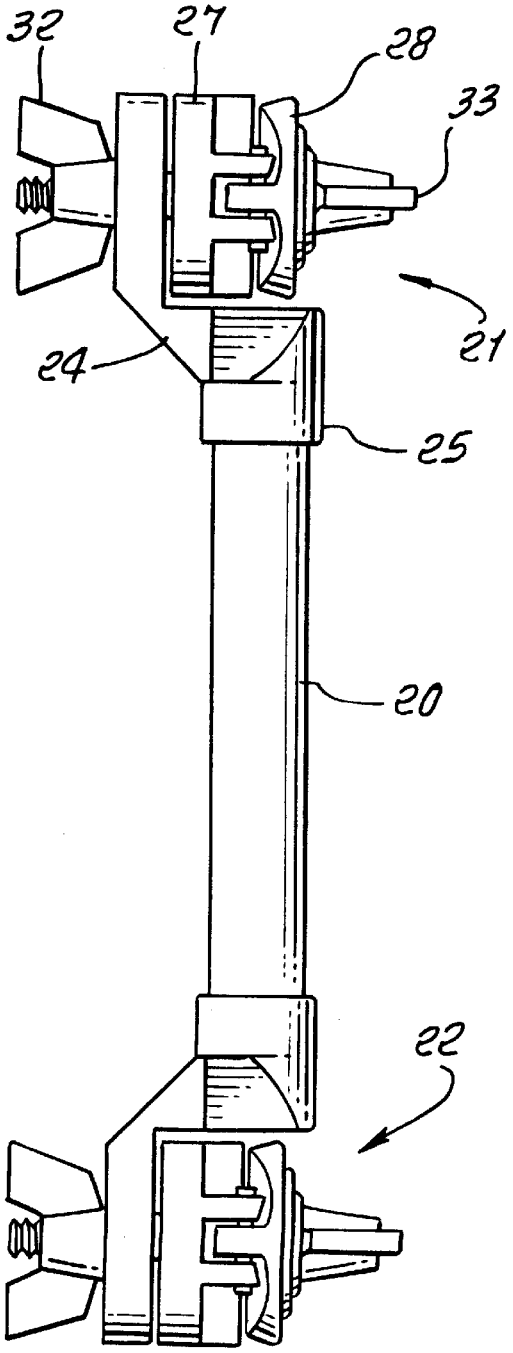
FIG. 5 is a left side elevation taken on lines 5—5 of FIG. 4.

Turning to FIGS. 2 and 3, the adapter 10 includes a longitudinally extending arm 20, a first clamp unit 21 carried at one end of the arm (for example to clamp rod 13), and a second clamp unit 22 carried at the opposite end of the arm (for example to clamp rod 14).

At least one of the units, and preferably each of the units 21 and 22 has elements including a carrier, a primary clamping plate and a secondary clamping plate, a primary fastener interconnecting the carrier and first clamp plate to laterally retain the primary clamping plate to the carrier, and a secondary fastener adjustably interconnecting the second clamp plate and first clamp plate, those plates defining rod receiving or clamping surfaces.

Figure 6:
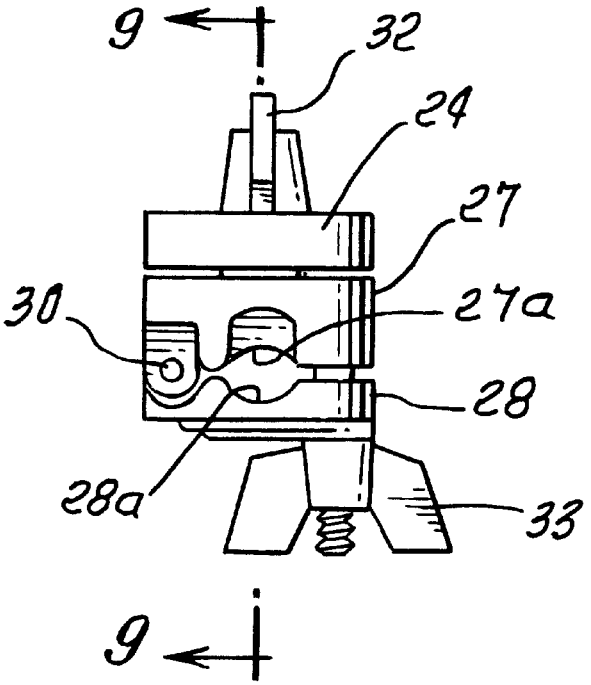
FIG. 6 is a top plan view taken on lines 6—6 of FIG. 2.
Figure 7:
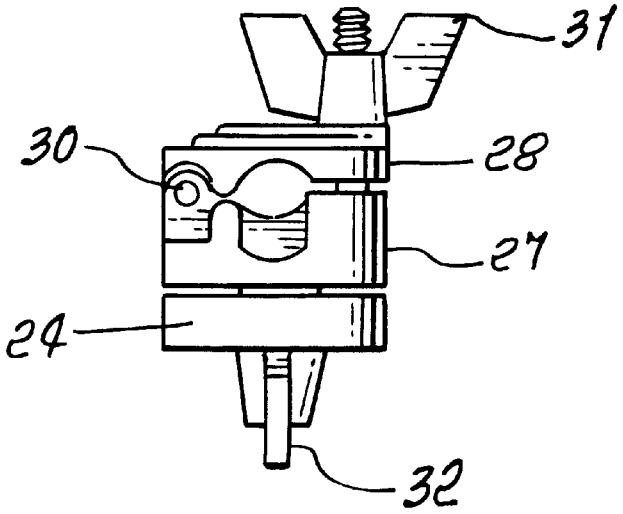
FIG. 7 is a bottom plan view taken on lines 7—7 of FIG. 2.

In the example, the upper unit carrier 24 is non-rotatable, it may be integral with a support body 25 which is integral with or attached to arm 20, and it is shown in FIG. 9 as offset laterally from a longitudinal axis 26 defined by arm 20. A primary clamping element such as a plate is seen at 27 as carried by the carrier 24, and a secondary clamping element such as a plate is seen at 28 as carried by the element 27. As seen in FIGS. 6 and 9, the two plates are interconnected as by a hinge 30 offset from a lateral axis 31.

The two plates are adjustably rotatable as a unit about axis 31 to a desired rod clamping position (allowing tilt angle adjustment of the cymbals) and a primary fastener including a wing nut 32 is then tightened, to clamp plate 27 to the carrier 24, preventing further rotation about axis 31. Axis 31 intersects axis 18. The two plates are then adjustably clamped toward one another and a secondary fastener including a wing nut 33 is then tightened, to clamp the inner concave surfaces 27*a* and 28*a* of the plates against opposite sides of the rod 13. See FIG. 8. The secondary fastener defines an axis 38 of wing nut 33 rotation, offset from lateral axis 31, and the hinge 30 and axis 38 are at opposite sides of lateral axis 31, providing a very compact, sturdy arrangement or combination of components at the upper clamp unit. Axis 31 is the axis of wing nut 32 rotation. Note fastener rod 50 in FIG. 8, carried by plate 27 to project through enlarged bore 51 in plate 28 for threadably receiving wing nut 33 threads. Nut 33 tightens on surface 28*a* of plate 28. Spring 52 urges plates 27 and 28 apart.

FIGS. 9–11 show a threaded rod 53 integral with plate 27 and projecting laterally along axis 31 through bore 54 in 24 and into a threaded bore 40 defined by the wing nut 32. As the nut is rotatably tightened, it draws the plate 27 rightwardly in FIG. 9 toward carrier 24, whereby teeth 41 and 42 on the plate and carrier interengage to block rotation of plate 27 about axis 31. A compression spring 45 extending between 24 and 27 urges plate 27 leftwardly.

The configuration described and shown allows the rod clamping surfaces 27*a* and 28*a* of the two plates to be located generally in alignment with the axis of the arm 20, to enhance adjustability.

The lower unit 22 and the lower end of the arm 20 embody the same or similar components as described for the upper unit, and such corresponding upper and lower unit components have the same identifying numbers.

Figure 8:
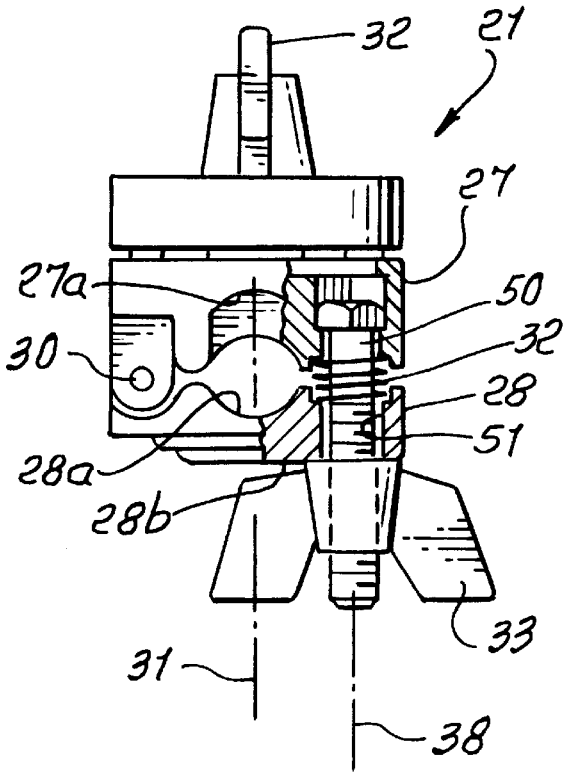
FIG. 8 is an enlarged view like FIG. 6, but broken away to show clamping mechanism.

Plates 27 and 28, and carrier 24 are generally cylindrical, as shown, and define a common lateral axis 31. As seen in FIG. 8 the wing nuts 32 and 33 are at laterally opposite sides of the unit 21, but their laterally extending axes of rotation are offset, enhancing compactness.

Figure 12:
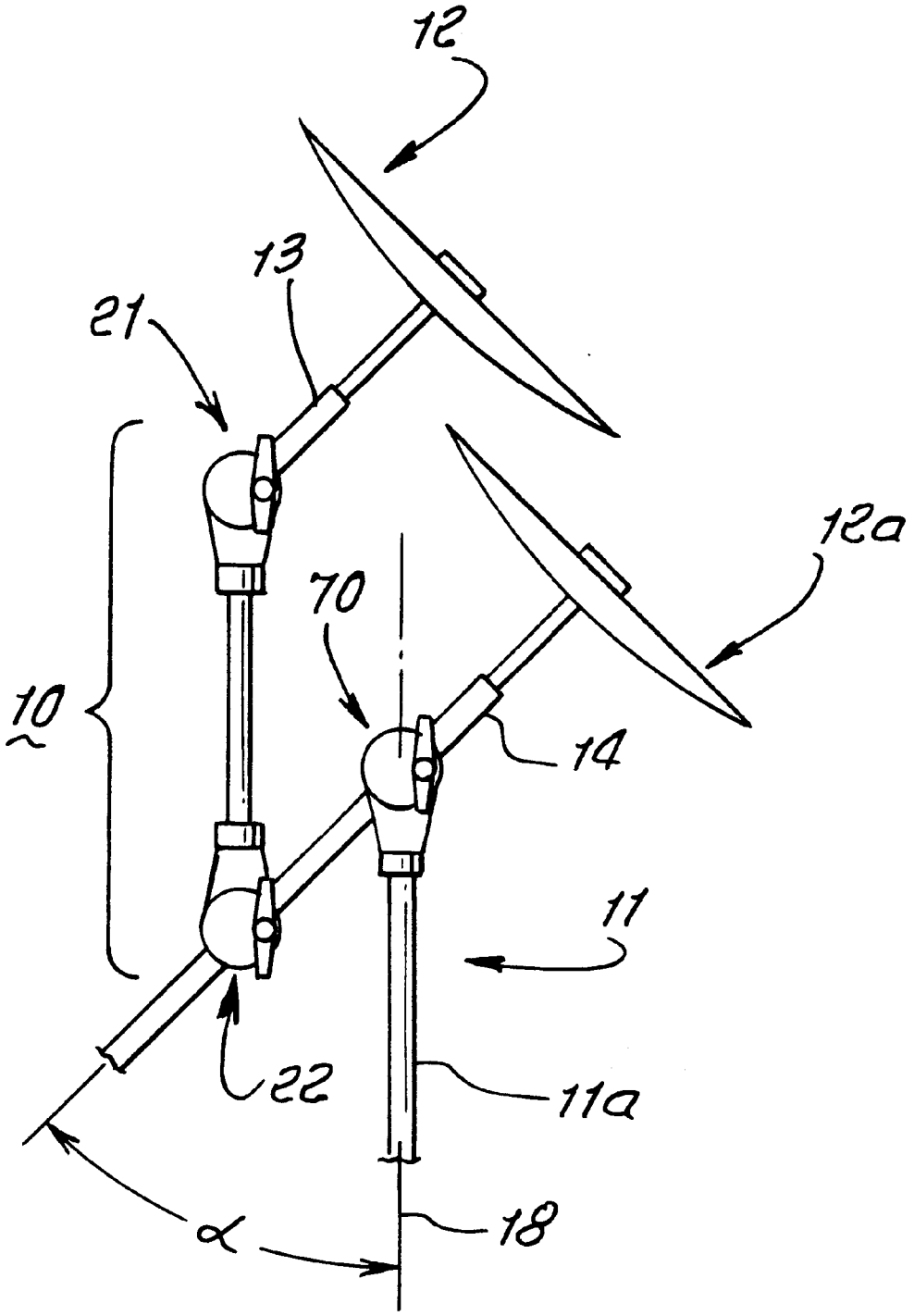
FIG. 12 is a view like FIG. 1, showing modification.

In FIG. 12, the cymbal stand component 11*a* (as also seen in FIG. 1) supports the adapter 10 to extend in offset relation to the upright axis 18. One rod 14 is clamped by the lower clamping unit 22 of the adapter and is also supported by head 70 at the top of the cymbal stand 11. Head 70 may have the same $\alpha$ construction as unit 21 or 22. Thus, rod 14 may be clamped by both 70 and 22, to extend at angle $\alpha$ relative to axis 18. A cymbal 12*a* may be carried by rod 14, as shown. Another cymbal 12 may be carried by rod 13, also extending at an angle relative to axis 18. Rods 13 and 14 may extend in parallel relation.

I claim:

1. A percussion instrument arm adapter, comprising a) a longitudinally extending arm, b) a first clamp unit carried at one end of said arm, and a second clamp unit carried at the opposite end of said arm, c) at least one of said units having primary elements including a carrier, a primary clamping plate and a secondary clamping plate, a primary fastener interconnecting the carrier and primary clamping plate to laterally retain the primary clamping plate to the carrier, and allow adjustable rotation of the primary clamping plate relative to the carrier, and a secondary fastener adjustably interconnecting the secondary clamp plate and first clamping plate, said plates defining rod clamping surfaces.

2. The percussion instrument arm adapter of claim 1 including means relatively pivotally interconnecting said plates.

3. The percussion instrument arm adapter of claim 2 including a spring located to urge the second plate to swing generally laterally, in a direction away from said first plate.

4. The percussion instrument arm adapter of claim 1 wherein said fasteners include wing nuts located at laterally opposite sides of said unit.

5. The percussion instrument arm adapter of claim 4 wherein said plates and carrier are generally cylindrical and define a laterally extending primary axis, about which the two plates are rotatable relative to the carrier, said second fastener wing nut defining a secondary axis offset from said primary axis.

6. The percussion instrument arm adapter of claim 1 wherein said one unit carrier has a port with telescopic interconnection with said arm.

7. The percussion instrument arm adapter of claim 6 wherein said primary fastener is located to releasably clamp said one unit carrier to said arm, blocking rotation of the carrier relative to the arm.

8. The percussion instrument arm adapter of claim 7 wherein the arm defines a longitudinal axis, the arm having an arm portion offset from said longitudinal axis, the carrier having a lateral axis of rotation, said rod clamping surfaces located generally in alignment with said longitudinal axis.

9. The percussion instrument arm adapter of claim 1 wherein the other of said units has secondary elements corresponding to said primary elements.

10. The percussion instrument arm adapter of claim 1 including means pivotally interconnecting said plates.

11. The percussion instrument arm adapter of claim 10 including a spring located to urge the second plate to swing generally laterally, in a direction away from said first plate.

12. The percussion instrument arm adapter of claim 1, including also a cymbal supported by said arm.

13. A percussion instrument arm adapter, a) a longitudinally elongated arm defining a longitudinal axis, b) said arm having a support body at each end thereof, each support body having a carrier laterally offset from said longitudinal axis, c) and a clamping unit carried by each carrier to be adjustably rotatable about a lateral axis, d) each clamping unit having rod clamping elements that are positioned for relative adjustment to clamp to a rod.

14. The percussion instrument arm adapter of claim 13 wherein said rod clamping elements of each unit include:

i) a primary clamping element carried by the carrier, ii) a secondary clamping element movably carried by the primary clamping element and iii) a fastener operatively interconnecting said elements for relative movement to adjustably clamp a rod therebetween.

15. The percussion instrument arm adapter of claim 13 including an elongated rod clamped by each clamping unit.

16. The percussion instrument arm adapter of claim 15 including a cymbal stand having an upright axis, said arm offset from said axis, one rod also carried by the cymbal stand to support said arm offset from said axis, the other rod supporting a cymbal in offset relation to said axis.

17. The percussion instrument arm adapter of claim 16 wherein said rod clamping elements of each unit are adjustably rotatably attached to the carrier associated with that unit.

18. A percussion instrument arm adapter, comprising a) a longitudinally extending arm, b) a clamp unit carried at one end of said arm, c) said unit having primary elements including a carrier a primary clamping plate and a secondary clamping plate, a primary fastener interconnecting the carrier and first clamp plate to laterally retain the primary clamping plate to the carrier, and a secondary clamp plate, and a secondary fastener adjustably interconnecting the second clamp plate and first clamp plate, said plates defining rod retaining surfaces.

19. The percussion instrument arm adapter of claim 18 wherein said fasteners include wing nuts located at laterally opposite sides of said unit.

20. The percussion instrument arm adapter of claim 19 wherein said plates and carrier are generally cylindrical and define a laterally extending primary axis, said second fastener wing nut defining a secondary axis offset from said primary axis.

* * * * *